United States Patent [19]

Gomaa

[11] 4,093,027

[45] June 6, 1978

[54] METHOD OF ASSISTING THE RECOVERY OF OIL USING STEAM

[75] Inventor: Ezzat E. Gomaa, El Cerrito, Calif.

[73] Assignee: Chevron Research Company, San Francisco, Calif.

[21] Appl. No.: 746,564

[22] Filed: Dec. 1, 1976

[51] Int. Cl.[2] ..... E21B 43/24

[52] U.S. Cl. ..... 166/272

[58] Field of Search ..... 166/272, 252, 303, 263

[56] References Cited

U.S. PATENT DOCUMENTS

| | | | |
|---|---|---|---|
| 3,193,009 | 7/1965 | Wallace et al. | 166/272 |
| 3,237,692 | 3/1966 | Wallace et al. | 166/272 X |
| 3,262,500 | 7/1966 | Waterman | 166/272 X |
| 3,421,583 | 1/1969 | Koons | 166/272 X |
| 3,476,183 | 11/1969 | Haynes, Jr. et al. | 166/272 |
| 3,477,510 | 11/1969 | Spillette | 166/272 |
| 3,483,924 | 12/1969 | Blevins et al. | 166/272 |
| 3,499,488 | 3/1970 | Haynes, Jr. et al. | 166/272 X |
| 3,500,915 | 3/1970 | Fitzgerald | 166/272 |

OTHER PUBLICATIONS

Willhite, "Overall Heat Transfer Coefficients in Steam and Hot Water Injection Wells", Journal of Petroleum Tech., vol. 19 (May, 1967), pp. 607–615.

*Primary Examiner*—Stephen J. Novosad

*Attorney, Agent, or Firm*—R. L. Freeland, Jr.; Edward J. Keeling

[57] ABSTRACT

A method of improving hydrocarbon recovery from a hydrocarbon-bearing formation utilizing a steam drive from an injection well to a production well wherein the quality of the injected steam is maintained at a value between 35 and 45% to maximize the heat utilization of the steam.

3 Claims, 26 Drawing Figures

INITIAL OIL SATURATION = 50%
INITIAL VAPOR SATURATION = 0
INITIAL RESERVOIR TEMP. = 90 °F.
STEAM QUALITY = 0%
TOTAL HEAT INJECTED = 395 MMBTU/AC. FT.

STEAM QUALITY = 20%

STEAM QUALITY = 80%

STEAM QUALITY = 100%

EFFECT OF STEAM QUALITY ON DISPLACEMENT PARAMETERS $S_{oi} = 50\%$
$T_{ri} = 90\,^{\circ}F.$
$S_{vi} = 0$
$q_{\flat} = 395$ MMBTU/AC. FT.

ZONE OF $S_o \geq S_{oi}$,
50% ISOSATURATION $S_o$

INJECTOR PRODUCER

UNIFORMITY OF WELLBORE HEATING,
150 °F. ISOTHERM

INJECTOR PRODUCER

STEAM ZONE GROWTH AND BREAKTHROUGH
10% ISOSATURATION $S_v$

INJECTOR PRODUCER

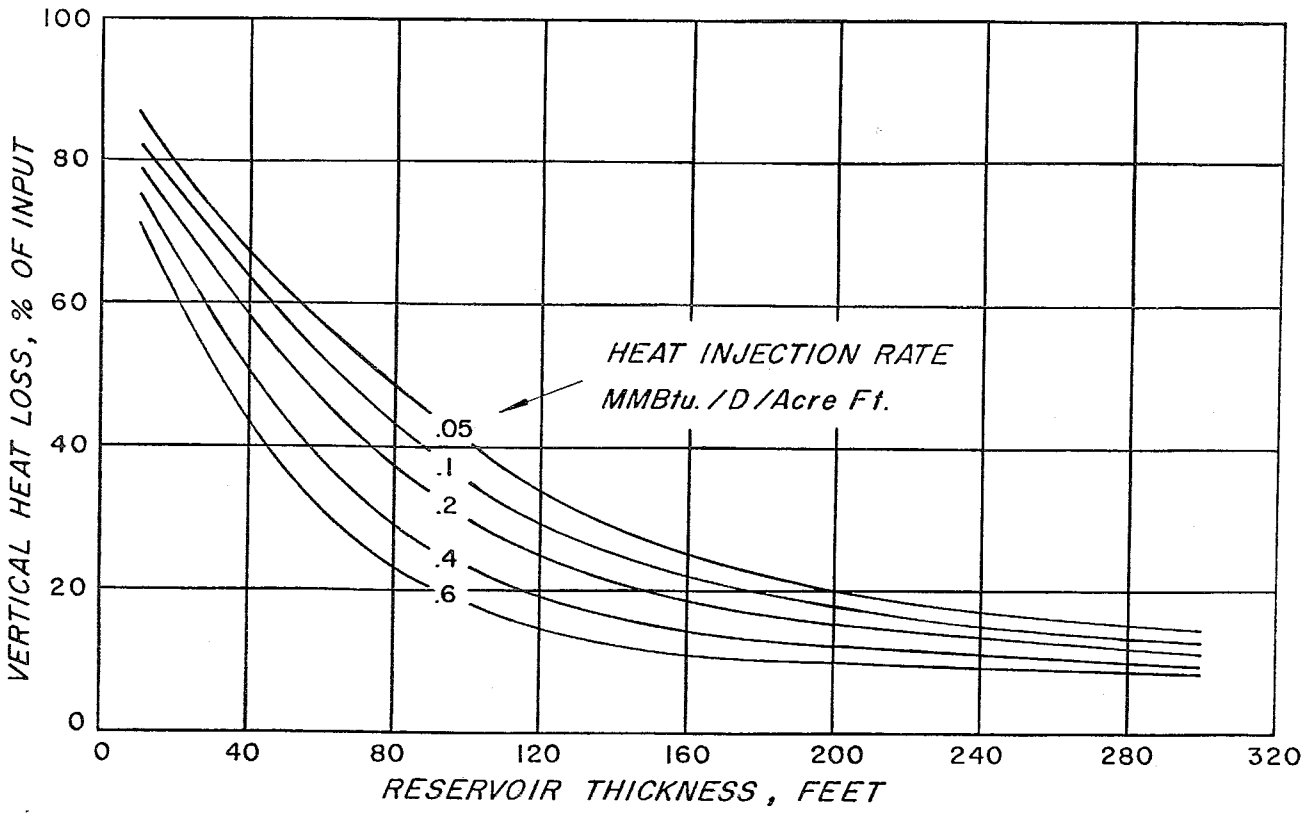
Fig. 12: HEAT LOSS TO OVERLYING & UNDERLYING STRATA

METHOD OF ASSISTING THE RECOVERY OF OIL USING STEAM

FIELD OF THE INVENTION

The present invention relates to improving the efficiency of a steam drive in the assisted recovery of hydrocarbons. Steam of a predetermined quality is injected through at least one injection well into a hydrocarbon-containing formation and is driven out into the formation to assist in moving oil to at least one production well for production of hydrocarbons from the formation.

BACKGROUND OF THE INVENTION

Many different methods of using steam to assist hydrocarbon recovery from a formation have been suggested or used heretofore. Recently, a great deal of steam injection has been done in the field using what is known as "wet" steam. In these field operations the wet steam was usually about 80% quality. This quality steam has been used in "huff and puff" steam operations and also in "steam drive" operations. Huff and puff involves injecting steam into a formation through an injection well, stopping the injection of steam, permitting the formation to soak and then back producing hydrocarbons through the original injection well. Steam drive involves injecting steam through an injection well into a formation and utilizing the steam to moved hydrocarbons to a spaced apart production well also penetrating the formation. In the past the practice in the field has been to inject steam having a quality of about 80%. This has been done because the generators used in the field conveniently produce steam of this quality. In theory and in fact, if steam is injected at a given rate the higher the quality of the steam the greater the production in a given time. However, it has now been discovered that, as set out herein, injecting very high quality steam does not result in maximum heat utilization.

BRIEF DESCRIPTION OF THE INVENTION

The present invention relates to an improved steam drive method for recovering oil from a hydrocarbon-containing formation. The quality of the injected steam is controlled to a value so that steam of a quality of between about 35 and 45% enters the formation from the injection well. The present method is particularly useful in relatively thick hydrocarbon-containing formations having at least 30 feet of hydrocarbon-containing interval. An injection well is provided with apparatus for injecting steam and a producing well is completed for producing oil from the formation at a location spaced apart from the injection well. The steam is formed and the quality of the steam is adjusted to provide 35 to 45% quality steam for injection into the formation. The steam is continuously injected into the formation while maintaining this quality and oil is produced from the production well.

PRINCIPAL OBJECT OF THE INVENTION

The principal object of the present invention is to provide a method of optimizing the recovery of petroleum in a steam drive by maintaining the quality of the injected steam within predetermined limits which insures maximum efficiency of heat utilization in the formation. Additional objects and advantages of the present invention will become apparent from a detailed reading of the specification and drawings which are incorporated herein and made a part of this specification.

BRIEF DESCRIPTION OF THE DRAWINGS

FIG. 12 shows curves of vertical heat loss to overlying and underlying strata.

Referring now to the drawings, and to FIG. 1 in particular, the preferred embodiment of the apparatus assembled in accordance with the present invention is illustrated. While it is recognized that the method of the present invention can be accomplished using a variety of apparatus, it is preferred that the apparatus used in performing the method of the present invention be assembled in accordance with the illustrated in FIG. 1. As shown in FIG. 1, a producing formation 20 is penetrated by an injection well 22. A flow tube 24 is arranged in the well 22 and provides a flow path for steam down the well to the producing zone 20. In most applications, it is desirable to have a packer 23 located above and close to the producing formation 20.

Figure 1:
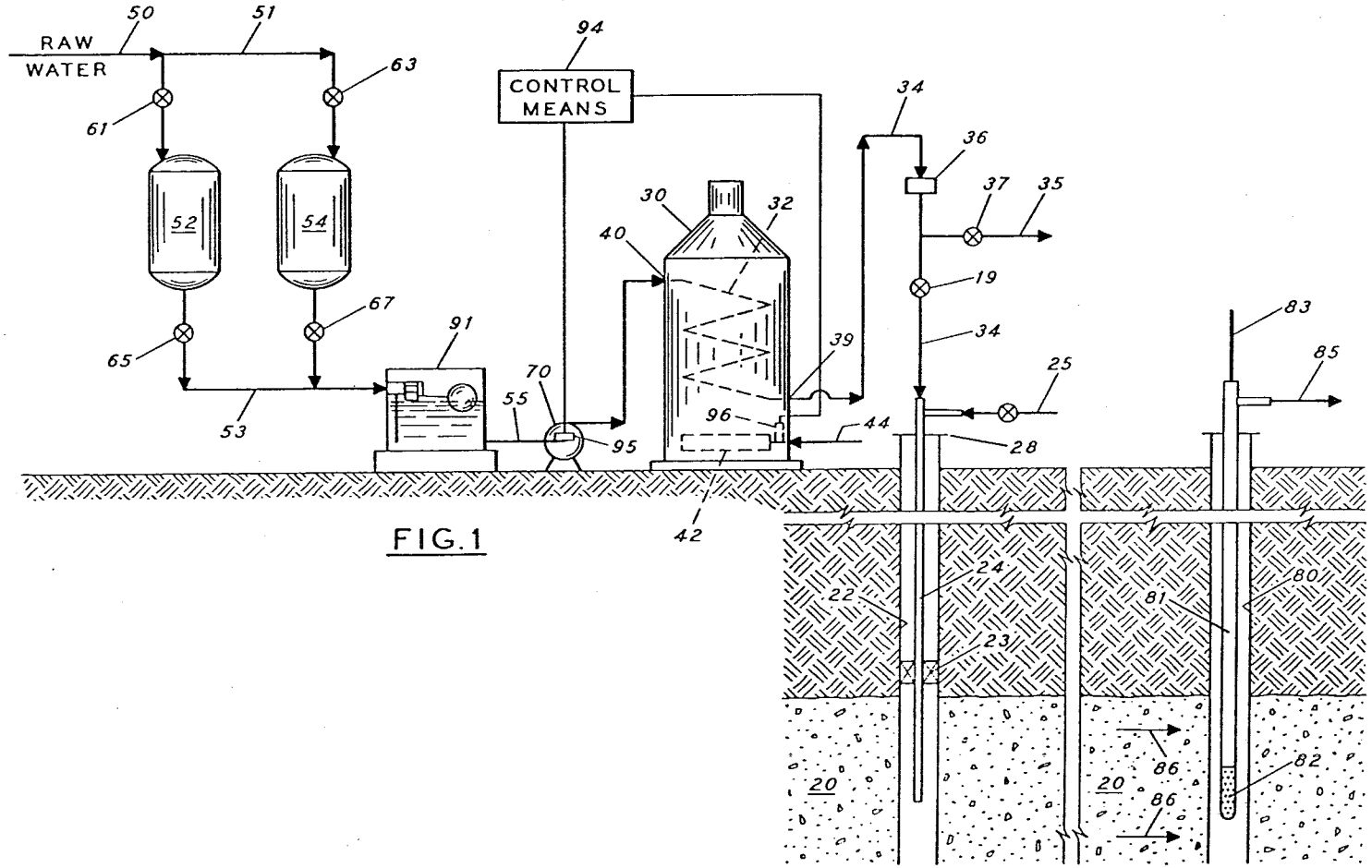
FIG. 1 is a schematic elevation view, partially in section, and illustrates apparatus assembled in accordance with the invention.

At least one producing well 80 which also penetrates producing formation 20 is required in accordance with the present invention. In actual field operations the method of the present invention will generally utilize a large number of wells. The injection wells and the production wells will be selected in accordance with a preplanned pattern. For example, 5-spot or 7-spot patterns may be useful in the present invention. In any event, each producing well 80 has suitable producing equipment such as a string of producing tubing 81, the lower end of which contains a pump 82. The production pump 82 is located adjacent producing formation 20 so that the pump may keep the well pumped off, i.e. keep the fluid level in the well at or below the producing formation. The pump is operated by means of sucker rods 83 which lifts oil to gathering line 85. Arrows 86 indicate oil flow changes promoted in accordance with the present invention. This is caused initially by steam injected into formation 20 through well 22.

The surface equipment preferred for providing steam for injection into formation 20 includes a suitably sized once through steam generator 30. The steam generator 30 is provided with steam generating tubes 32. These tubes 32 are arranged in a once through flow arrangement. Appropriate piping 34 connects the outlet of the steam gathering tubes to the downhole steam flow tube 24. A flow bean, or appropriate valve 36, is used to regulate steam flow into the well. A bleed line 35 having a suitable valve 37 should be provided above the wellhead 28. Suitable apparatus for measuring steam quality is also provided downstream of the steam generator 30.

A source of raw water for making steam is illustrated by the number 50. Most, if not all, of the water available for use in oil field operations contains ions of a scale forming nature such as calcium and/or magnesium. Water treating means, such as tanks 52 and 54, are connected by suitable piping 51, 53 and 55 for supplying treated water to the boiler 30. Valves 61, 63, 65 and 67 are useful to control water flow through water treating tanks 52 and 54. The water treating tanks preferably contained an ion exchange resin which converts the relatively insoluble calcium and magnesium salts to a relative soluble salt, such as the sodium salt, which will stay in solution and not cause undesirable scaling. A particular advantage of the present invention in using relatively low-quality steam is that more undesirable salts can be carried in the liquid portion of the wet steam therefore the water treatment is not so critical. Downstream of the water treating tanks 52 and 54 a reservoir 91 provides storage for extra treated water to insure that water will be available at the suction of the pump 70 used to supply the steam generator 30. A flow type reservoir which is activated by lowering of the water to open the upstream flow line 53 in the tank has been found to give good results.

In accordance with the present invention, the rate of water flow through coils 32, or the heat provided by burner 42, is adjusted to provide steam of a desired temperature and quality. The water content of the steam is sufficient to maintain salts in solution and thus prevent excessive scaling in the boiler tubes or flow line to the well.

In accordance with the invention, the temperature of the injected steam is maintained in excess of 230° F, and preferably at temperatures in the range of 250°–450° F. Temperatures exceeding about 500°–600° F are normally not used. A control means 94 is utilized for controlling the heat provided by burner 42 or the amount of water moved by pump 70, or both, to provide steam at a selected temperature and a quality of between 35 to 45% at the formation face. A speed regulator 95 on the pump may be activated by the control means to vary the amounts of water flowing into the steam generator. A valve 96 may, for example, be controlled by the control means to adjust the amount of fuel gas or fuel oil flowing into the burner. Thus the temperature and quality of the steam leaving steam generator 30 at exit 39 may be controlled as desired.

The steam is injected into the formation through an injection well. Usually the injection and production wells will be arranged in a repeated pattern over a field. As is well known in the art, 5-spot or 7-spot patterns are often used. In a 7-spot arrangement, for example, a centrally located well may be used as an injection well and six peripherally spaced wells are used as production wells. If desired, the arrangement may be reversed with the six outside wells serving as injection wells and the single control well being used for production of oil. The present invention is not tied to any particular arrangement of wells, and generally speaking good engineering practice and prior development of the field will determine well spacing for use in the present invention.

Figure 2:
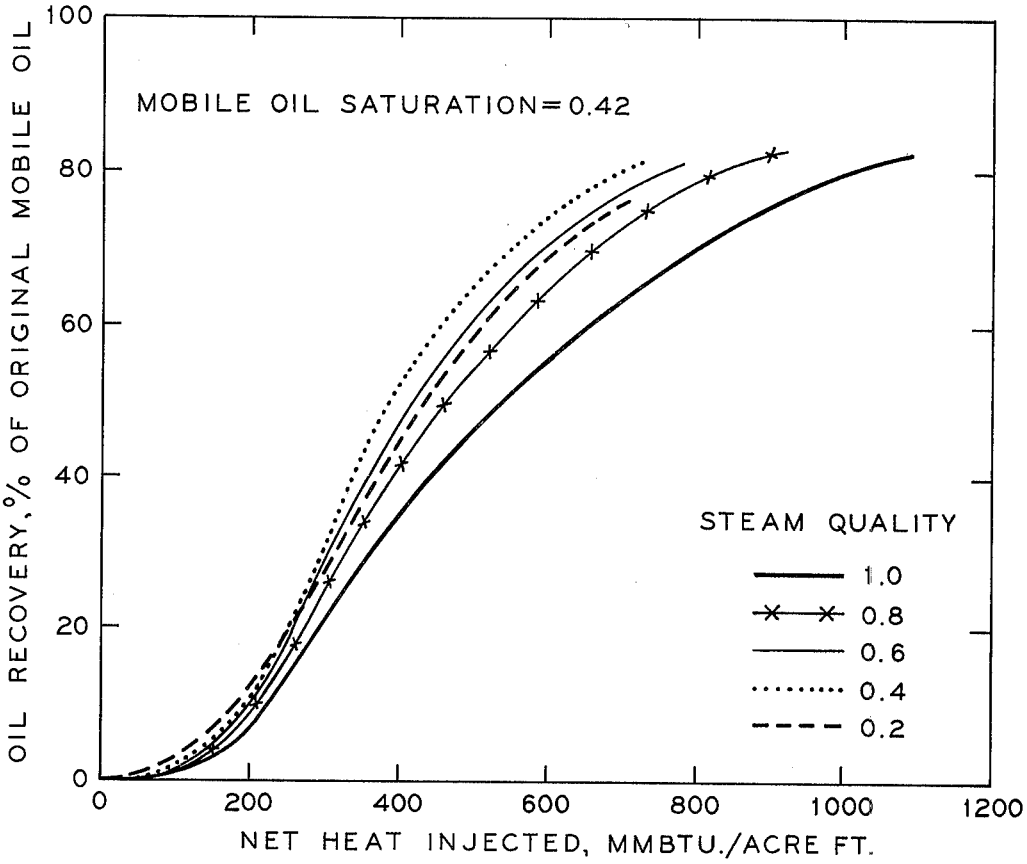
FIG. 2 is a graph showing the effect of steam quality on oil recovery.

In FIG. 2, the effects of steam quality on oil recovery is shown in terms of net heat injected. At any fixed value for net heat injected, oil recovery is dependent on steam quality. The net heat injected is defined as the difference between total heat injected at the formation face minus the heat lost to overlying and underlying strata. These heat losses are plotted in FIG. 12 in terms of reservoir thickness and heat injection rate. Thus, it is noted in FIG. 2 that oil production versus net heat injected increases as the quality is progressively lowered from 100% quality to about 40% quality. Lowering the quality below 40%, i.e., 20% quality, results in less oil recovery. Thus, it has been found that maintaining injected steam quality at about a value of 40% will give more efficient heat utilization than the higher quality steam. This is not to infer that the injection of higher quality steam will not give more immediate and greater recovery at fixed injection rates. However, it is apparent that the efficiency of utilizing the heat injected may be maximized by maintaining the quality in the 40% range.

Figure 3:
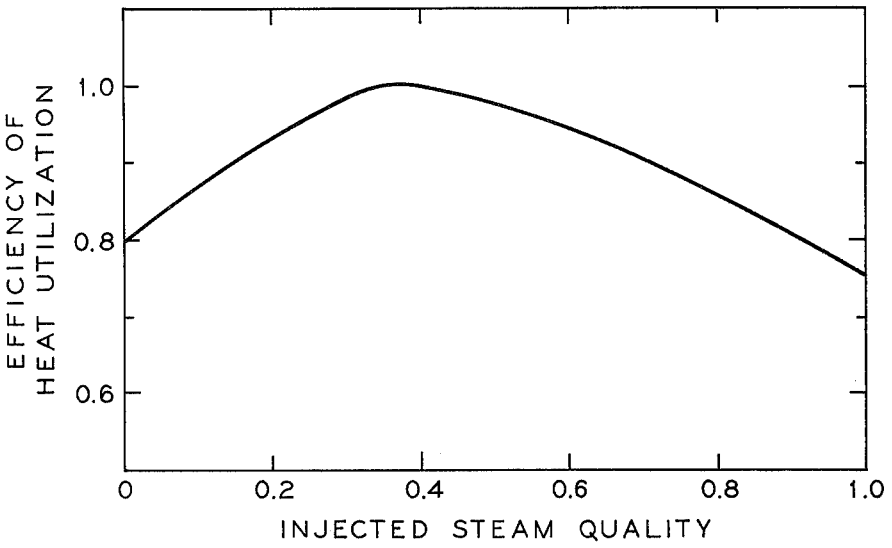
FIG. 3 is a graph showing efficiency of heat utilization of injected steam as a function of quality.

FIG. 3 shows the efficiency of heat utilization of injected steam as a function of the quality. Referring to FIG. 3, it is seen that greatest efficiency is obtained when the quality of the steam injected into the formation is maintained between about 35 and about 42%. Less efficient heat occurs above 42% quality, however, in accordance with the invention, the quality may be increased to about 45% in order to obtain some acceleration in the recovery of the oil without seriously lowering the efficiency of heat utilization.

Figure 4:
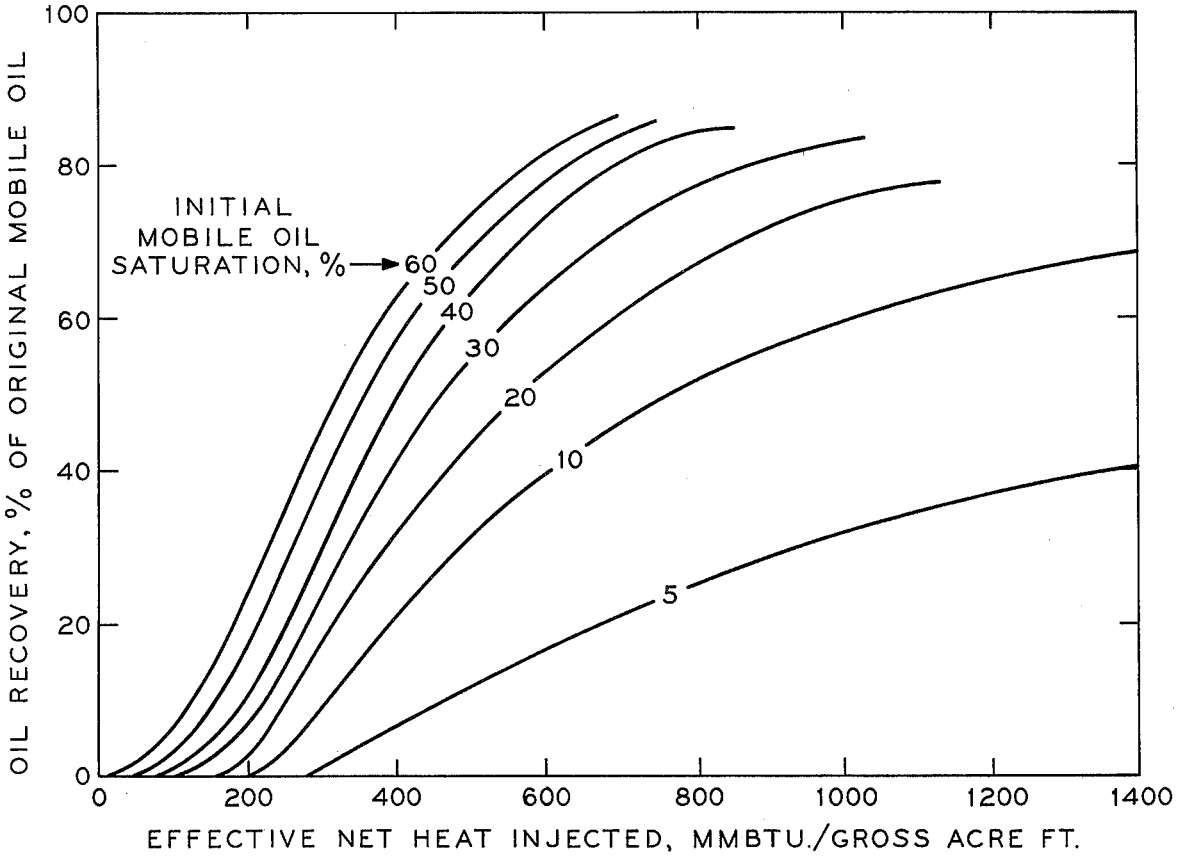
FIG. 4 is a graph showing steam flood oil recovery as a function of effective net heat injected and oil saturation.

FIG. 4 is a graph showing plots of steam flood oil recovery as a function of effective net heat injected and oil saturation. The effective net heat is defined as the product of net heat and the efficiency of heat utilization. FIG. 4 indicates that an effective net heat of at least 700 MMBTU/gross acre feet should be injected to achieve ultimate oil recovery.

Figure 5A:
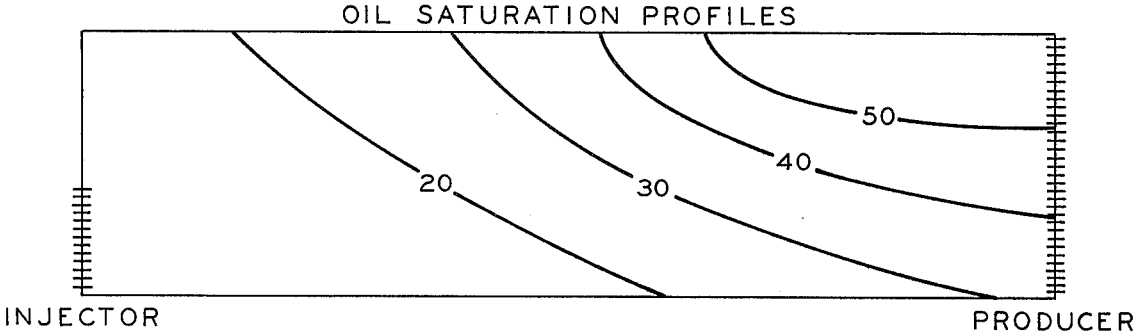
FIGS. 5A, B, C through FIGS. 10A, B, C show plots of oil saturation profiles (A), temperature profiles (B) and steam saturation profiles (C) for various quality of steam injected.
Figure 9A:
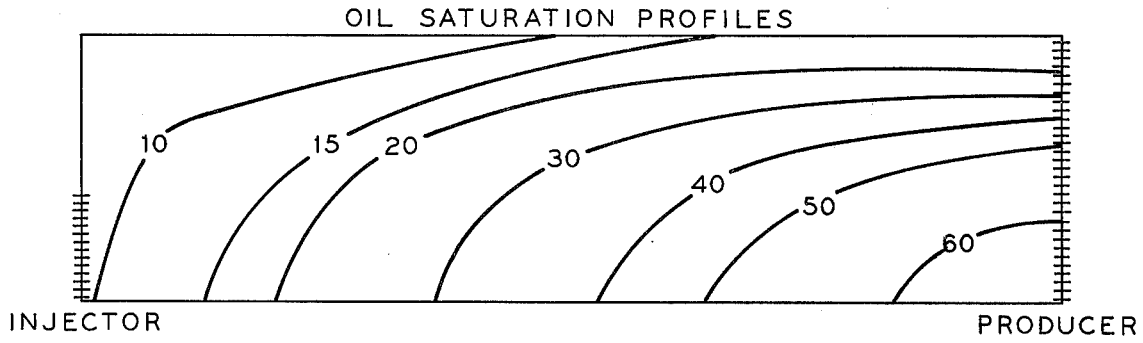
Figure 9B:
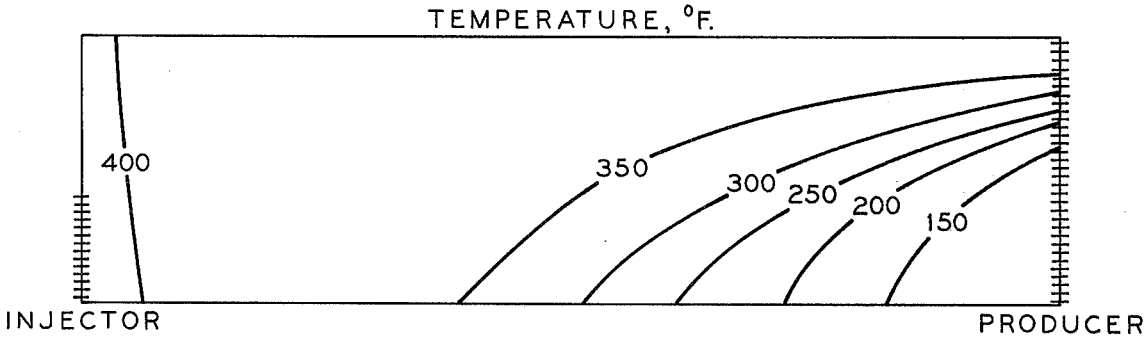
Figure 9C:
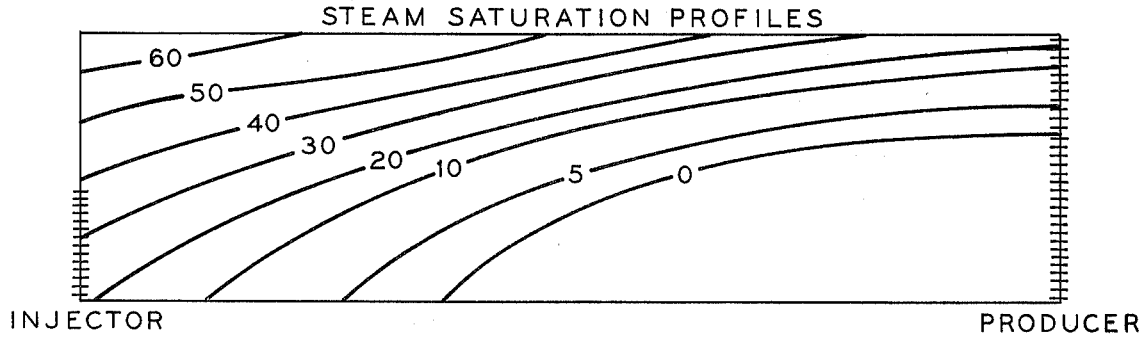
Figure 10A:
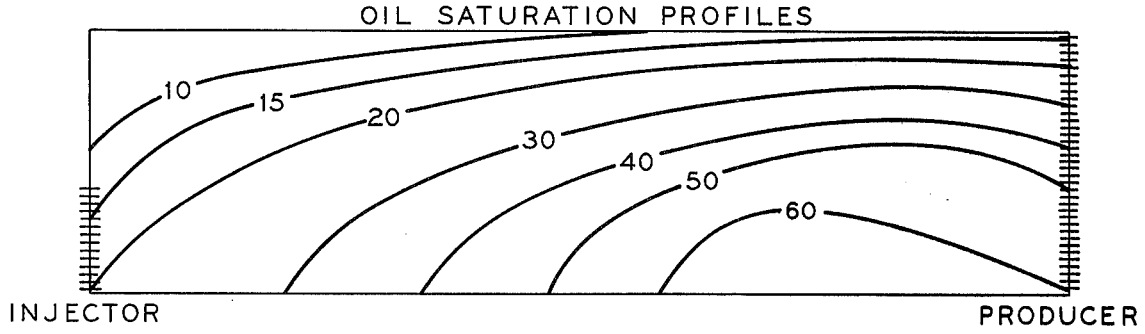

FIGS. 5A, B, C through FIGS. 10A, B, C show the effects of varying the quality of the steam in a steam drive. FIGS. 5A–10A show oil saturation profiles in a vertical cross section of a formation between an injector and a producer. FIGS. 5B–10B show temperature profiles in degrees Farenheit in a vertical cross section of a formation between an injector and a producer. FIGS. 5C–10C show steam saturation profiles in a vertical cross section of a formation between an injector and a producer.

Figure 5B:
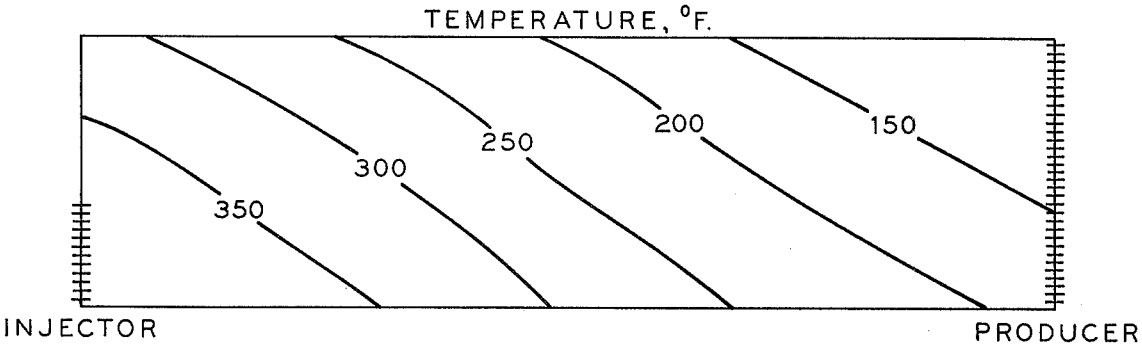
Figure 5C:
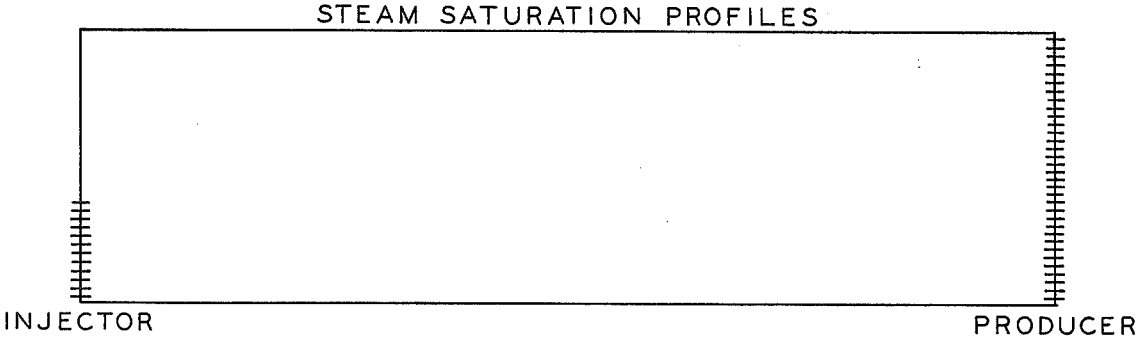
Figure 6A:
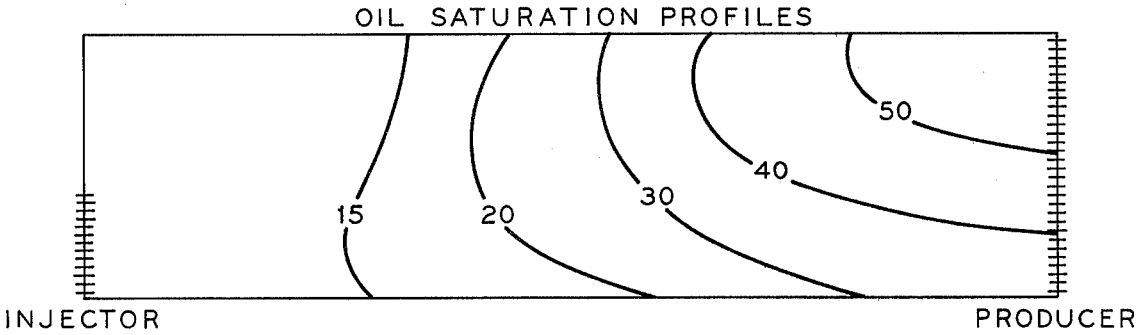
Figure 6B:
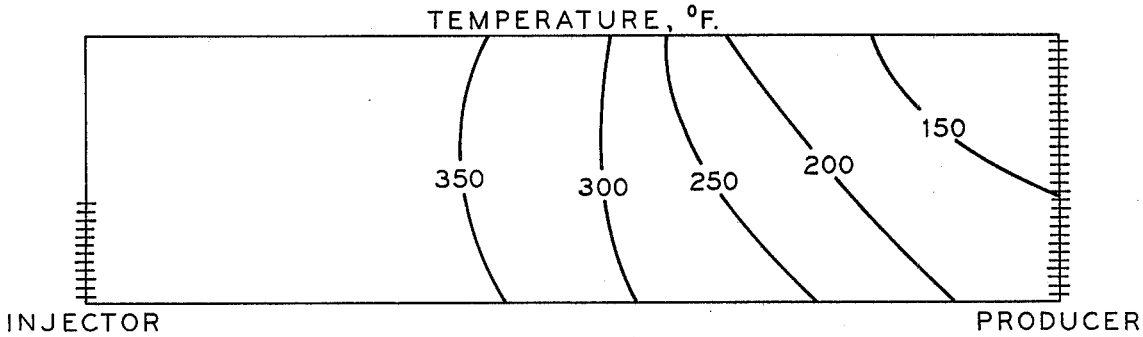
Figure 6C:
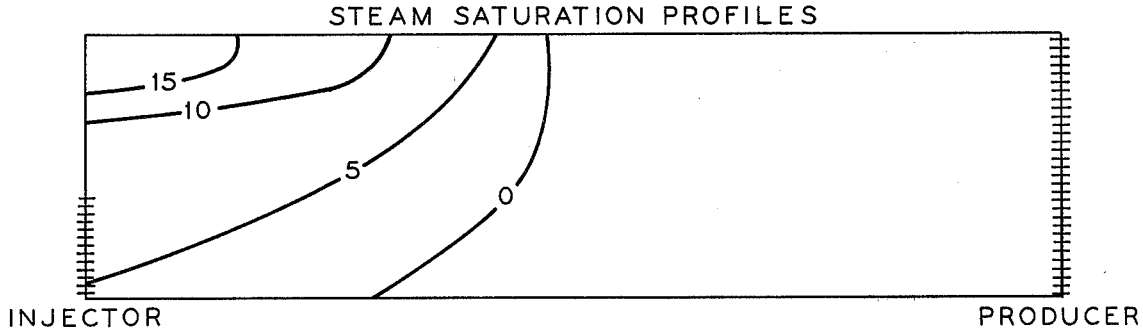
Figure 7A:
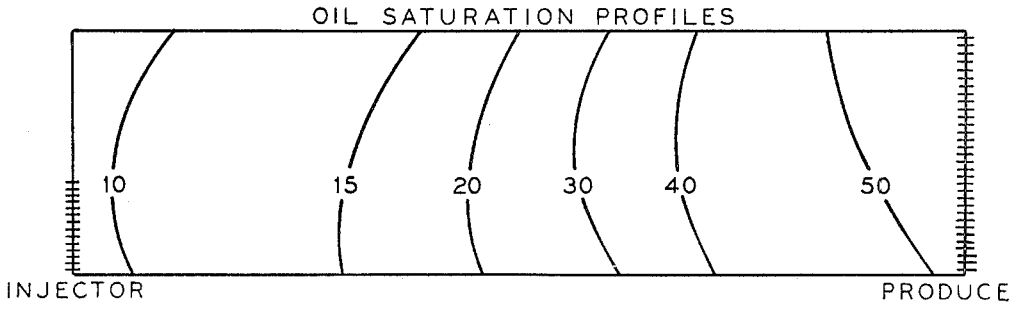
Figure 7B:
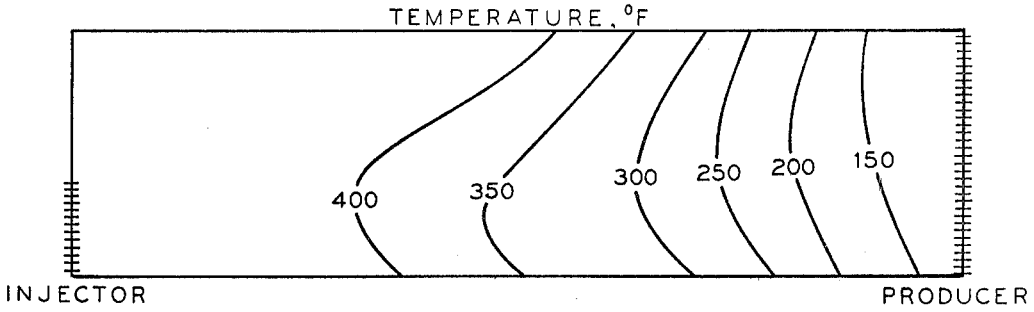
Figure 7C:
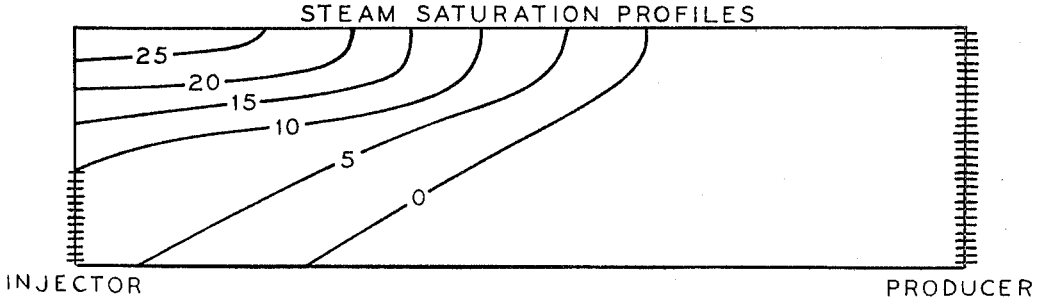
Figure 8A:
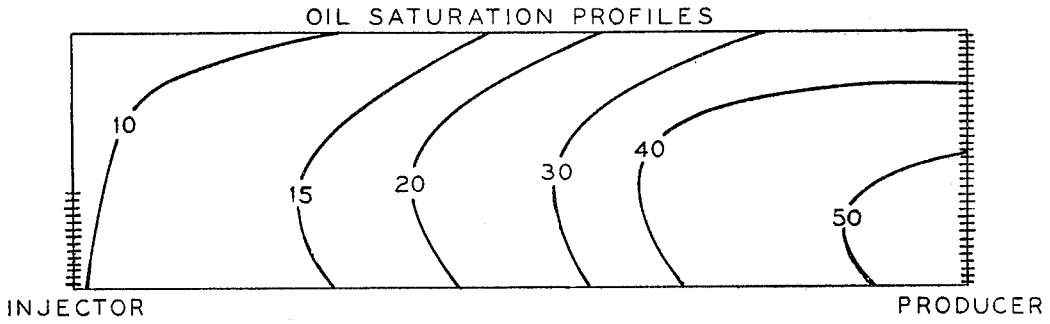
Figure 8B:
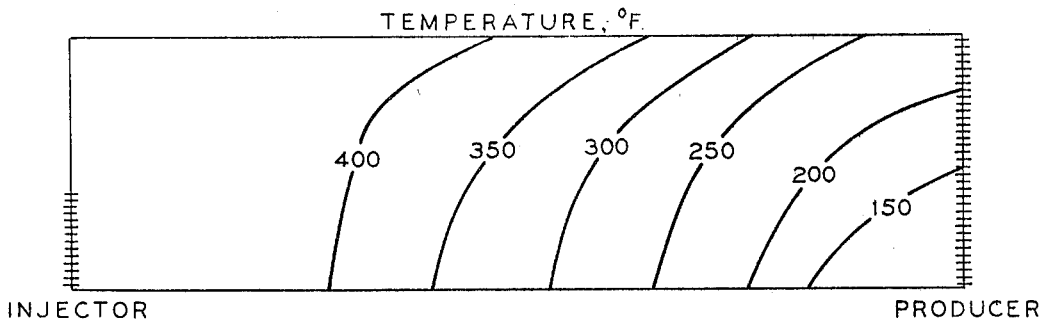
Figure 8C:
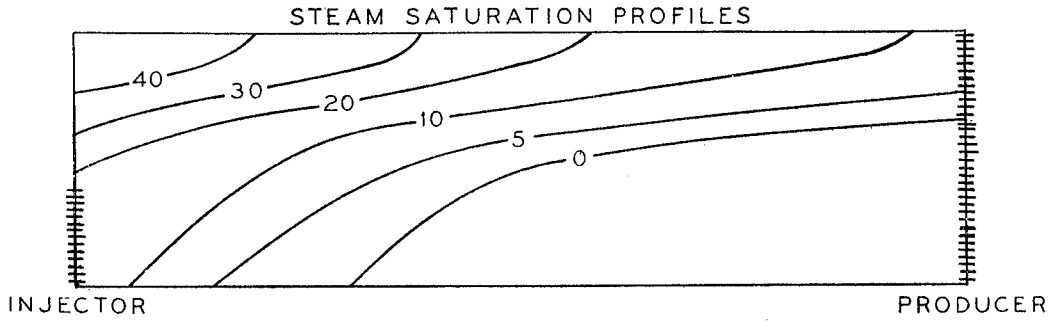
Figure 10B:
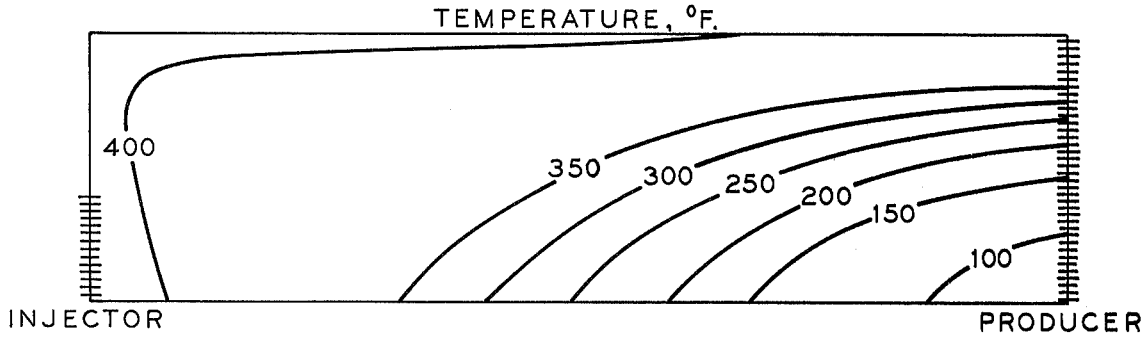
Figure 10C:
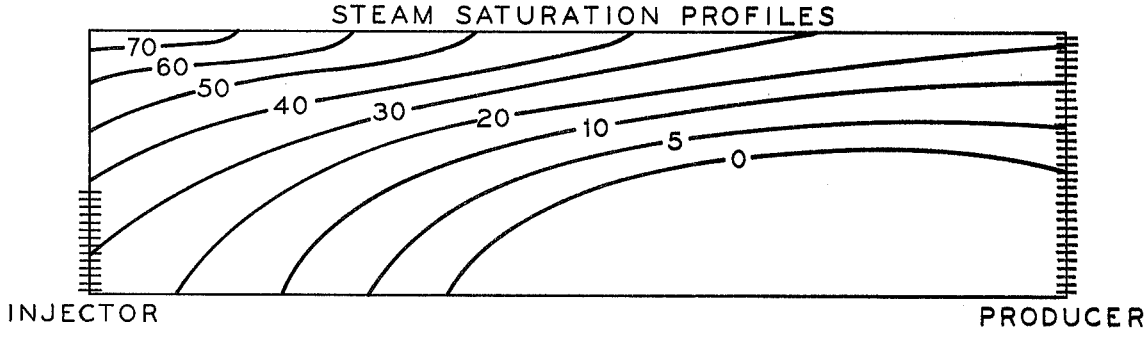

FIGS. 5A, 5B, 5C are for a hot water flood where steam quality is 0. In a relatively thick formation during such a hot water flood, the oil saturation profiles and the temperature profiles indicate that the water underruns the oil and moves preferentially in the bottom portion of the reservoir. This results in early water breakthrough and leads to bypassing a great deal of cold oil in the upper portion of the formation. FIGS. 6A, 6B, 6C show the profiles when quality of the injected steam is maintained at 20%. These show that hot water underruns the oil and a significant amount of cold oil is still left at the top of the formation. The effect however is not as severe as the case of the hot water flood. FIGS. 7A, 7B, 7C show what occurs when the quality of injected steam is maintained at 40%. Note that the oil saturation and temperature profiles are approximately vertical indicating a uniform sweep and heating of the formation. This would therefore result in the most efficient displacement of the oil in the formation. FIGS. 8A, 8B, 8C illustrate what happens in a formation when 60% quality steam is injected. Note that the oil saturation profiles, temperature profiles and steam saturation profiles indicate that the vapor overrides the oil and preferentially moves near the top of the formation. This results in early steam breakthrough and higher heat losses. This also might result in bypassing of oil near the bottom of the formation. FIGS. 9A, 9B, 9C show results of injection of steam at 80% quality. These profiles show an increasing effect of overriding vapor and bypassing oil near the bottom of the formation. Also the heat losses are greater because of a greater production of vapor. FIGS. 10A, 10B, 10C show results of injection of 100% quality steam. These results indicate the continued severe override of vapor and the resultant inefficient use of the heat due to extremely high heat losses and very early breakthrough. This is in effect a mirror image of the hot water flood with the trapped cold oil bank being near the bottom of the formation.

Figure 11A:
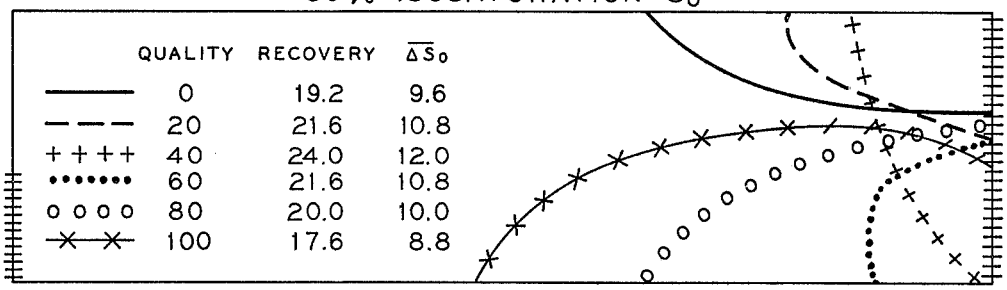
FIGS. 11A, B and C are plots showing the effect of steam quality on oil displacement parameters
Figure 11B:
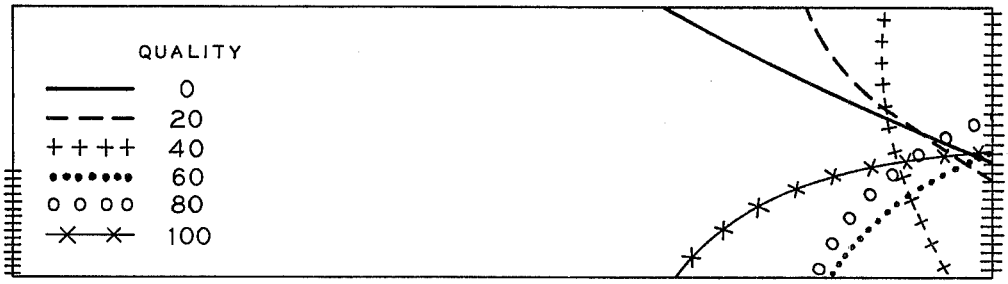
Figure 11C:
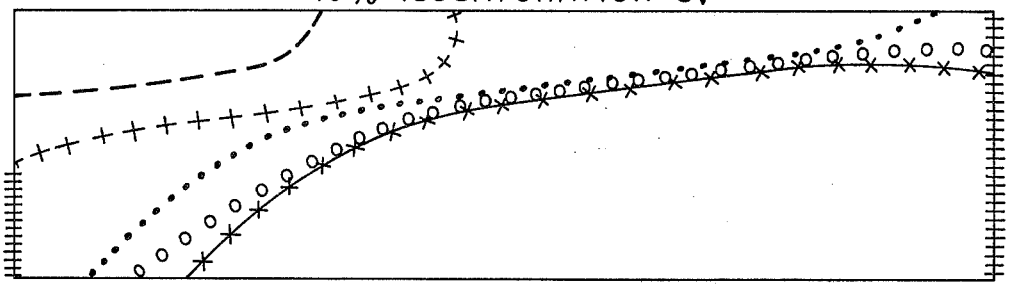

FIGS. 11A, 11B, and 11C show the accumulative effect of steam quality on displacement parameters. FIG. 11A shows the location of the oil bank caused by fluid injection. It indicates that the case of 40% quality steam results in essentially piston-like displacement thus providing a continuous high productivity due to uniformly high oil saturation near the producing well. FIG. 11B shows the degree of uniformity of production well heating. Again the 40% quality steam results in the most uniform heating front. FIG. 11C shows the vapor zone growth and its effect on vapor breakthrough. It indicates that for steam qualities of 60% and higher early vapor breakthrough will occur. As can be seen in these three FIGS. the overall efficiency of the steam flood is highly improved by maintaining the quality of the injected steam in the 35 to 45% range.

The manner of generating steam to yield a quality in the range of from 35 to 45% for injection at the formation face is well known in the art. Several methods are available in the literature for estimating reductions in steam quality due to heat losses through the injection well. A preferred technique is to combine G. P. Willhite Jr.'s "Over-All Heat Transfer Coefficients in Steam and Hot Water Wells", Journal of Petroleum Technology, Vol. 19 (1967), page 607 with R. C. Earlaugher Jr.'s "Some Practical Considerations in the Design of Steam Injection Wells", Journal of Petroleum Technology, Vol. 21 (1969), page 79. Methods of measuring the steam quality are well known and the steam producing apparatus can be adjusted to provide a quality of steam which will enter into the formation at a 35 to 45% quality.

Although specific embodiments of the preferred invention have been described herein, the invention is not limited to only these embodiments but rather by the scope of the appended claims.

I claim:

1. In a method of assisting the recovery of hydrocarbons from a hydrocarbon-bearing formation wherein steam is injected through an injection well into a hydrocarbon-bearing formation to promote a flow of hydrocarbons to a production well for production therefrom, the improvement comprising maintaining the quality of the steam injected into the formation within a range of from 35 to 45%.

2. The method of claim 1 wherein the quality of steam is maintained at between 35 and 42%.

3. The method of claim 1 wherein the quality of steam is maintained at about 40% quality.

* * * * *